US006357353B1

(12) United States Patent
Vermeersch et al.

(10) Patent No.: US 6,357,353 B1
(45) Date of Patent: Mar. 19, 2002

(54) DRY METHOD FOR PREPARING A THERMAL LITHOGRAPHIC PRINTING PLATE PRECURSOR

(75) Inventors: Joan Vermeersch, Deinze; Luc Leenders, Herentals; Augustin Meisters, Gentbrugge, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/501,224

(22) Filed: Feb. 10, 2000

Related U.S. Application Data

(60) Provisional application No. 60/127,155, filed on Mar. 31, 1999.

(30) Foreign Application Priority Data

Feb. 23, 1999 (EP) ..... 99200528

(51) Int. Cl.[7] ..... B41C 1/10
(52) U.S. Cl. ..... 101/466; 101/467
(58) Field of Search ..... 101/463.1, 465–467, 101/478; 430/49, 302

(56) References Cited

U.S. PATENT DOCUMENTS 3,921,527 A * 11/1975 Raschke et al. ..... 101/463.1
3,933,665 A * 1/1976 Van Engeland et al. .... 430/109
5,254,421 A * 10/1993 Coppens et al. ..... 101/465
5,346,797 A * 9/1994 Kmiecik-Lawrynowicz et al. ..... 430/137
5,683,848 A 11/1997 Ong et al. ..... 430/137

FOREIGN PATENT DOCUMENTS

| | | |
|---|---|---|
| CA | 2195826 | 7/1997 |
| EP | 0 099 264 | 1/1984 |
| EP | 770495 | * 5/1997 |
| GB | 1157918 | 7/1969 |

OTHER PUBLICATIONS

A. S. Diamond: "Handbook of Imaging Materials", Marcel Dekker, New York, XP0020111081.

* cited by examiner

*Primary Examiner*—Stephen R. Funk
(74) *Attorney, Agent, or Firm*—Breiner & Breiner, L.L.C.

(57) ABSTRACT

According to the present invention there is provided a method for making a negative working non-ablative imaging material, suitable for making a lithographic printing plate, including the steps of applying a dry powder containing at least a compound capable of converting light into heat and an organic compound on a surface of a non-electrically charged metal support, characterized in that the amount of organic compound in the powder ranges from 51 to 95% by weight.

9 Claims, No Drawings

DRY METHOD FOR PREPARING A THERMAL LITHOGRAPHIC PRINTING PLATE PRECURSOR

This application claim benefit to Provisional No. 60/127, 155 filed Mar. 31, 1999.

FIELD OF THE INVENTION

The present invention relates to a method for making a heat-mode lithographic printing plate precursor and a lithographic printing master in computer-to-plate and computer-to-press procedures.

BACKGROUND OF THE INVENTION

Rotary printing presses use a so-called master such as a printing plate which is mounted on a cylinder of the printing press. The master carries an image which is defined by the ink accepting areas of the printing surface and a print is obtained by applying ink to said surface and then transferring the ink from the master onto a substrate, which is typically a paper substrate. In conventional lithographic printing, ink as well as an aqueous fountain solution are fed to the printing surface of the master, which is referred to herein as lithographic surface and consists of oleophilic (or hydrophobic, i.e. ink accepting, water repelling) areas as well as hydrophilic (or oleophobic, i.e. water accepting, ink repelling) areas.

Printing masters are generally obtained by the so-called computer-to-film method wherein various pre-press steps such as typeface selection, scanning, color separation, screening, trapping, layout and imposition are accomplished digitally and each color selection is transferred to graphic arts film using an image-setter. After processing, the film can be used as a mask for the exposure of an imaging material called plate precursor and after plate processing, a printing plate is obtained which can be used as a master.

In recent years the so-called computer-to-plate method has gained a lot of interest. This method, also called direct-to-plate method, bypasses the creation of film because the digital document is transferred directly to a plate precursor by means of a so-called plate-setter. In the field of such computer-to-plate methods the following improvements are being studied presently:

(i) On-press imaging. A special type of a computer-to-plate process, involves the exposure of a plate precursor while being mounted on a plate cylinder of a printing press by means of an image-setter that is integrated in the press. This method may be called 'computer-to-press' and printing presses with an integrated image-setter are sometimes called digital presses. A review of digital presses is given in the Proceedings of the Imaging Science & Technology's 1997 International Conference on Digital Printing Technologies (Non-Impact Printing 13). Computer-to-press methods have been described in e.g. EP-A 770 495, EP-A 770 496, WO 94001280, EP-A 580 394 and EP-A 774 364. The best known imaging methods are based on ablation. A problem associated with ablative plates is the generation of debris which is difficult to remove and may disturb the printing process or may contaminate the exposure optics of the integrated image-setter. Other methods require processing with chemicals which may damage the electronics and other devices of the press.

(ii) On-press coating. Whereas a plate precursor normally consists of a sheet-like support and one or more functional coatings, computer-to-press methods have been described wherein a composition, which is capable to form a lithographic surface upon image-wise exposure and optional processing, is provided directly on the surface of a plate cylinder of the press. EP-A 101 266 describes the coating of a hydrophobic layer directly on the hydrophilic surface of a plate cylinder. After removal of the non-printing areas by ablation, a master is obtained. However, ablation should be avoided in computer-to-press methods, as discussed above. U.S. Pat. No. 5,713,287 describes a computer-to-press method wherein a so-called switchable polymer such as tetrahydro-pyranyl methylmethacrylate is applied directly on the surface of a plate cylinder. The switchable polymer is converted from a first water-sensitive property to an opposite water-sensitive property by image-wise exposure. The latter method requires a curing step and the polymers are quite expensive because they are thermally unstable and therefore difficult to synthesize. EP-A 802 457 describes a hybrid method wherein a functional coating is provided on a plate support that is mounted on a cylinder of a printing press. This method also needs processing. A major problem associated with known on-press coating methods is the need for a wet-coating device which needs to be integrated in the press.

(iii) Elimination of chemical processing. The development of functional coatings which require no processing or may be processed with plain water is another major trend in plate making. WO 90002044, WO 91008108 and EP-A 580 394 disclose such plates, which are, however, all ablative plates. In addition, these methods require typically multi-layer materials, which makes them less suitable for on-press coating. A non-ablative plate which can be processed with plain water is described in e.g. EP-A 770 497 and EP-A 773 112. Such plates also allow on-press processing, either by wiping the exposed plate with water while being mounted on the press or by the fountain solution during the first runs of the printing job.

(iv) Thermal imaging. Most of the computer-to-press methods referred to above use so-called thermal materials, i.e. plate precursors or on-press coatable compositions which comprise a compound that coverts absorbed light into heat. The heat which is generated on image-wise exposure triggers a (physico-) chemical process, such as ablation, polymerization, insolubilization by cross-linking of a polymer, decomposition, or particle coagulation of a thermoplastic polymer latex. This heat-mode process then results in a lithographic surface consisting of ink accepting and ink repelling areas.

EP-A- 786 337 discloses a process for imaging a printing plate, wherein the printing plate is charged over the whole surface and over the whole surface is covered with toner particles, which are charged oppositely. Thereon is the layer, formed by the particles imagewise fixed or imagewise ablated by infrared exposure on the surface of the printing plate. Thereafter the parts which are not fixed are removed and optionally the non-ablated areas are fixed by heating over the whole surface of the plate. This process requires a cumbersome development.

A problem associated with most thermal materials disclosed in the prior art is that these materials are suitable for exposure with either an internal drum image-setter (i.e. typically a high-power short-time exposure) or an external drum image-setter (i.e. relatively low-power long-time exposure). Providing a universal material that can be exposed with satisfactory results on both these types of laser devices known in the art is a requirement difficult to fulfill.

OBJECTS OF THE INVENTION

It is an object of the present invention to provide a cost effective method for preparing a material which is suitable for making a printing master for conventional lithographic printing by using computer-to-plate, computer-to-press or on-press coating methods and which requires no processing or can be processed with plain water. It is another object of the present invention to provide a method for making a universal material which can be exposed with internal as well as external drum image-setters.

Further advantages of the present invention will become apparent from the following description.

SUMMARY OF THE INVENTION

According to the present invention there is provided a method for making a negative working non-ablative imaging material, suitable for making a lithographic printing plate, comprising the steps of applying a dry powder containing at least a compound capable of converting light into heat and an organic compound on a surface of a non-electrically charged metal support, characterized in that the amount of organic compound in said powder ranges from 51 to 95% by weight.

DETAILED DESCRIPTION OF THE INVENTION

Said organic compound is present in said powder in an amount of at least 51%. Said organic compound is preferably a thermoplastic polymer particle, more preferably with a diameter between 0.02 μm and 10 μm, most preferably between 0.050 μm and 2 μm. Preferred thermoplastic polymers are novolac, polystyrene or a polyacrylate, used alone or mixed with one or two of the other components. Preferably said thermoplastic polymer particles contain a reactive compound inside or outside these particles. Particles containing reactive compounds inside the particles are prepared according to the well known technique of preparing microcapsules or by adding the reactive compound in a water immiscible solvent to the particles dispersed in water. Particles containing reactive compounds outside the particles are prepared according to the well known technique of loading latices as described in EP-A-483 416. Reactive compounds are compounds which can cause cross-linking. Preferred reactive compounds are melamine resins, urethanes, phenol-formaldehyde resins and epoxy compounds.

The compound which is capable of converting light into heat is preferably an organic dye or pigment, carbon black, graphite, metal carbides, borides, nitrides, carbonitrides, or oxides.

The materials made by the method of the present invention are preferably sensitive to near infrared light. Accordingly, the compound capable of converting light into heat is preferably a near infrared light absorbing compound such as carbon or an infrared dye. It is also possible to use dry, finely divided polymer particles consisting of e.g. a polypyrrole or polyaniline-based polymer. The infrared dyes listed in Table 1 are highly preferred.

TABLE 1

Cpd 1

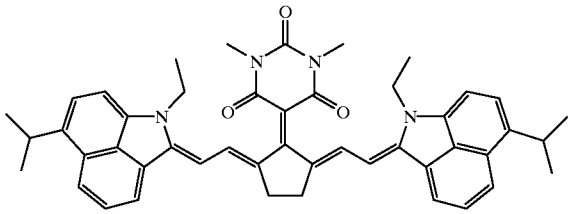

Cpd 2

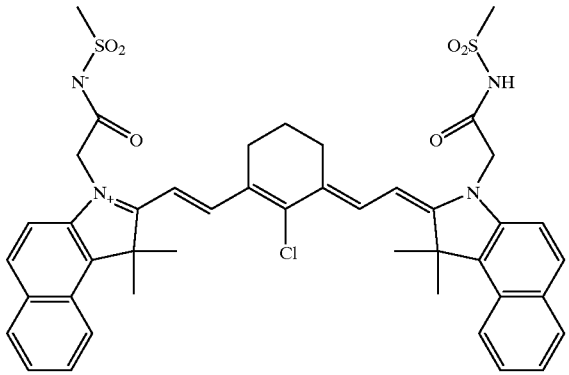

TABLE 1-continued
Cpd 3
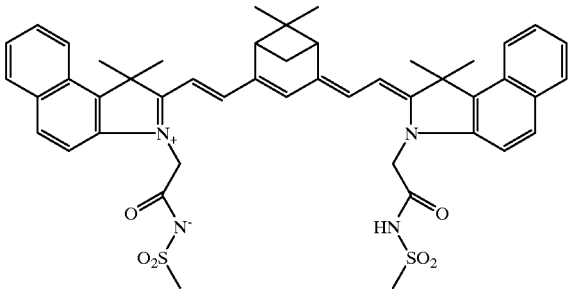
Cpd 4
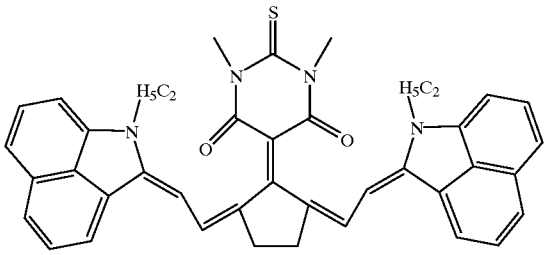
Cpd 5
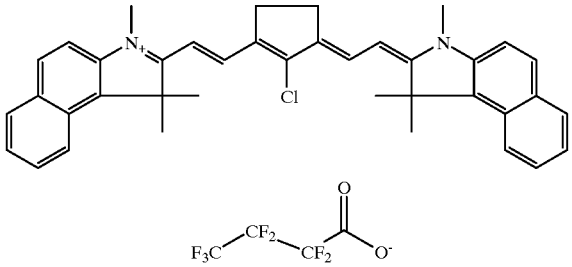
Cpd 6
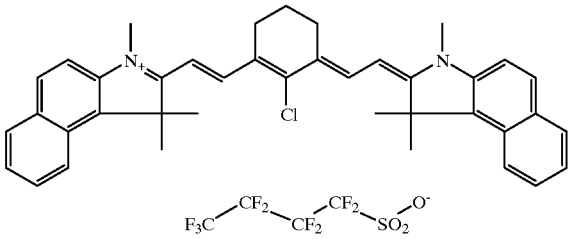
Cpd 7
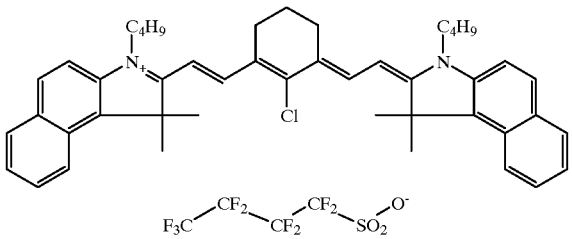

TABLE 1-continued

Cpd 8

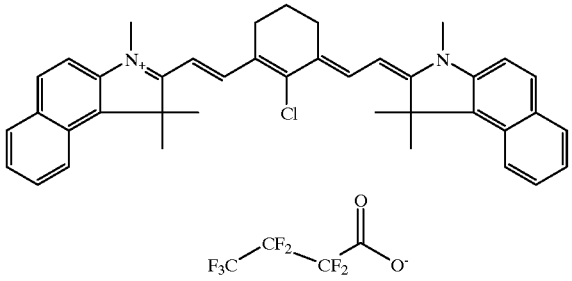

Cpd 9

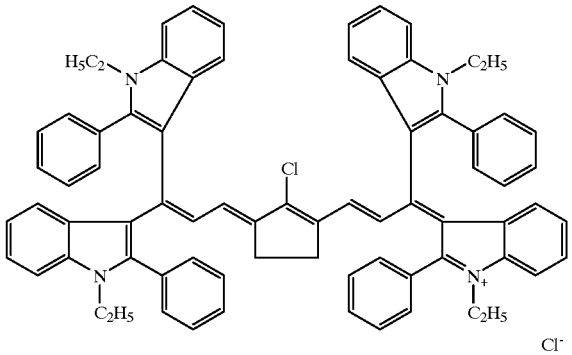

Cpd 10

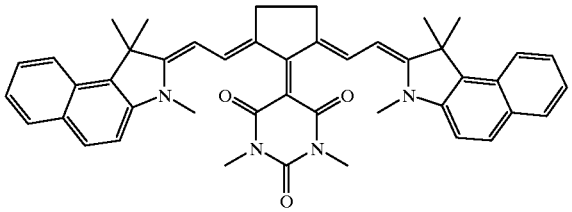

Cpd 11

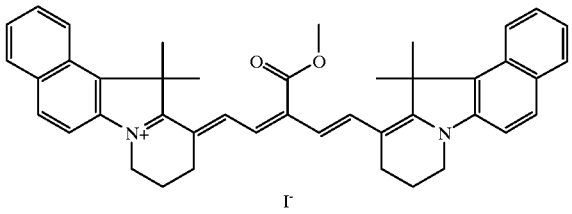

The amount of the compound capable of converting light into heat is in the range of 5 to 49% by weight, more preferably between 10 to 49% by weight of the dry powder.

The compound capable of converting light into heat can also be incorporated in or adsorbed to or mixed with the polymeric particles or is heterogeneously mixed with said organic compound.

The materials made by the method of the present invention require no processing or can be processed with plain water. Since it is a dry coating method, the method of the present invention is very suitable for computer-to-press applications and on-press coating procedures.

The imaging mechanism of the materials that are made according to the present invention is not known, but may rely on a thermal interaction between the light absorbing compound and the metal support.

The features of the present invention, as specified in the claims, shall be understood as indicated hereafter. The word "image" is used herein in the context of lithographic printing, i.e. "a pattern consisting of oleophilic and hydrophilic areas". The material that is made according to the present invention is negative working, which means that the areas, which are exposed to light, are rendered oleophilic and thus ink accepting due to said exposure. In the context of the present invention, the feature "negative working" may be considered as an equivalent of the feature "non-ablative", since in ablative materials the functional layers are completely removed from the underlying (hydrophilic) metal support upon image-wise exposure so as to obtain a positive image (exposed areas are hydrophilic, ink repelling). Analysis of the exposed areas of the material made according to the method of the present invention indeed showed that the layer or stack of layers is not removed upon image-wise exposure but is converted into a hydrophobic surface on the metal support. The unexposed areas are hydrophilic or become hydrophilic after processing with plain water.

The dry powder used in the present invention may further comprise non-reactive compounds, i.e. inert components such as e.g. a matting agent or a filler. The word "inert" shall not be understood in the meaning of "non-functional", since these inert compounds may be added to the powder to adjust certain physical properties, such as e.g. surface roughness and friction coefficient of the applied layer or the Theological properties of the powder. The word "inert" shall rather be understood as meaning "not essential for the imaging process", though some inert compounds may have a (minor) influence on the speed and image quality of the material.

The method of the present invention may be used to apply a stack of layers on a metal support but a single layer is preferred. The compound capable of converting light into heat may be present in all the layers of said stack or may be localized in just a single layer of said stack. In a method according to the latter embodiment the layer comprising the compound capable of converting light into heat is preferably applied directly on the metal support. The layer comprising the compound capable of converting light into heat is preferably very thin, i.e having a dry layer thickness below 2 $\mu$m, preferably not higher than 1 $\mu$m.

The support used in the present invention is a non-electrically charged metal support. Preferred examples of said metal support are steel, especially polished stainless steel, and aluminum. Phosphor bronze (an alloy comprising >90 wt. % of copper, <10 wt. % of tin and small amounts of phosphor) can also be used. The aluminum support is preferably an electrochemically grained and anodized aluminum support. Most preferably said aluminum support is grained in nitric acid, yielding imaging elements with a higher sensitivity. The anodized aluminum support may be treated to improve the hydrophilic properties of its surface. For example, the aluminum support may be silicated by treating its surface with sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or can be carried out at a slightly elevated temperature of about 30 to 50° C. A further treatment may involve rinsing the aluminum oxide surface with a bicarbonate solution. Still further, the aluminum oxide surface may be treated with poly(vinyl phosphonic acid), poly(vinyl methylphosphonic acid), phosphoric acid esters of poly(vinyl alcohol), poly(vinyl sulphonic acid), poly(vinyl benzenesulphonic acid), sulphuric acid esters of poly(vinyl alcohol), and acetals of poly(vinyl alcohols) formed by reaction with a sulphonated aliphatic aldehyde. It is evident that one or more of these post treatments may be carried out alone or in combination.

A highly preferred material made according to the present invention comprises a non-electrically charged anodized aluminum support and provided directly thereon a single recording layer which consists essentially of a compound capable of converting light into heat and thermoplastic polymer particles. On top of said recording layer there may be provided a top layer for protecting the recording layer against moisture, chemicals, oxygen, mechanical impact, etc.

According to the present invention, a non-electrically charged metal support can be applied with a dry powder by rubbing in the surface of said support with said dry powder. Alternative dry coating methods can also be used, e.g. sputter-coating of the powder on the metal support.

The method of the present invention can be used in computer-to-plate (off-press exposure) or computer-to-press (on-press exposure) procedures. The method may also involve on-press coating, i.e. applying a dry powder according to the present invention directly on the non-electrically charged metal surface of a cylinder of a rotary printing press. Said on-press coating can also be performed indirectly by applying the dry powder on a metal support which is mounted on a cylinder of a rotary printing press. In still another method according to the present invention, said composition can be applied on a metal sleeve which, after image-wise exposure and optional processing, is then transferred to a cylinder of a rotary printing press.

The dry powder may also be applied on the non-electrically charged metal support by contacting the surface of said support with another material, which carries a dry layer containing an organic compound and a compound capable of transferring light into heat which are then transferred to the metal support. The method of this embodiment can be automated easily, e.g. by incorporating a supply roll of such a transfer material, such as a ribbon impregnated with the dry powder in a print station of a digital press similar to the configuration which is described in EP-A 698 488. The transfer material can be unwound from said supply roll and the layer containing the dry powder can then be brought in direct contact with the surface of a plate cylinder by one or more contact rollers. After the transfer step, which may be carried out by applying pressure and/or heat on said transfer material while being in contact with the metal support, the used transfer material may he wound up again on a take-up roll. In the latter embodiment, the transfer of dry power can be carried out so as to obtain a uniform layer which then can be image-wise exposed. Alternatively said pressure and/or heat can he applied image-wise, so that the dry powder is transferred image-wise to the metal support. This step then may be followed by intense overall heating, e.g. by infrared laser exposure. However, if sufficient heat is applied during said image-wise transfer, a suitable printing master may directly he obtained without intense overall heating.

In an even more preferred embodiment of the automated method, described above, a dry coating unit as described above, consisting of a supply roll, one or more contact rollers and a take-up roll, is mounted on the same carriage as the laser exposure unit of an external drum image-setter. Reference is made to e.g. FIG. 1 of U.S. Pat. No. 5,713,287 which illustrates a similar device wherein a spray coating unit is mounted on the same carriage as the laser exposure unit in an external drum configuration. In this way, said dry coating unit moves in front of the laser exposure unit along the so-called slow scan axis, parallel to the axis of the plate cylinder. As the plate cylinder is rotated during image-wise exposure (fast scan movement), the whole surface of said cylinder passes the dry coating unit and a layer is coated along a spiral path around the cylinder. Since the laser exposure unit moves together with the dry coating unit, an area which has been coated during one revolution of the cylinder is exposed by the laser exposure unit a number of revolutions later, i.e. coating and image-wise exposing can be carried out almost simultaneously during the same scan procedure.

The materials made according to the present invention can be exposed to light by a light emitting diode or a laser such as a He/Ne or Ar laser. Preferably a laser emitting near infrared light having a wavelength in the range from about 700 to about 1500 nm is used, e.g. a semiconductor laser diode, a Nd:YAG or a Nd:YLF laser. The required laser power depends on the pixel dwell time of the laser beam, which is determined by the spot diameter (typical value of modern plate-setters at $1/e^2$ of maximum intensity: 10–25 μm), the scan speed and the resolution (i.e. the number of distinct pixels per unit of linear distance, often expressed in dots per inch or dpi; typical value: 1000–4000 dpi). A major benefit of the materials made according to the present invention is that they can be used as a universal imaging material which is suitable for exposure by internal (ITD) as well as external drum (XTD) image-setters. ITD image-setters are typically characterized by very high scan speed up to 500 m/sec and may require a laser power of several Watts. Satisfactory results have also been obtained by using XTD image-setters having a typical laser power from 100 mW to 500 mW at a lower scan speed, e.g. from 0.1 to 10 m/sec.

The unexposed areas of the material made according to the present invention can be removed easily by wiping the material after exposure with plain water. This step may be performed on-press, i.e. after mounting the exposed plate on the plate cylinder of a printing press. The materials can even be used as a printing master immediately after image-wise exposure without any additional processing because the unexposed areas are readily removed by the fountain solution or the ink applied during the first runs of the printing job.

The printing plate of the present invention can also be used in the printing process as a seamless sleeve printing plate. In this option the printing plate is soldered in a cylindrical form by means of a laser. This cylindrical printing plate which has as diameter the diameter of the print cylinder is slid on the print cylinder instead of mounting a conventional printing plate. More details on sleeves are given in "Grafisch Nieuws", 15, 1995, page 4 to 6.

Most printing plates described in the prior art require a so-called post-bake, i.e. an overall heating treatment after image-wise exposure and optional processing so as to increase the run length of the plate. The materials made according to the present invention allow to achieve satisfactory run lengths without a post-bake.

EXAMPLES

While the present invention will hereinafter be described in connection with preferred embodiments thereof, it will be understood that it is not intended to limit the invention to those embodiments.

Example 1

An aluminum support was electrochemically roughened using hydrochloric acid, anodized in sulphuric acid and subsequently treated with polyvinylphosphonic acid. The obtained hydrophilic surface was further used for the application of a dry powder.

Dry powders consisting of organic compounds and infrared absorbing compounds were used for rubbing in the above described hydrophilic surface of the electrochemically roughened and anodized aluminum support, using a cotton pad.

Powders with various types and ratios of the organic compound and the IR-absorbing compound were prepared and applied by dry rubbing.

The carbon black containing powders were prepared by mixing the aqueous carbon black dispersion with an aqueous latex or dispersion of the organic compound in an appropriate ratio and freeze drying the aqueous mixture to remove water from the mixture. The carbon black used in these experiments is PRINTEX L6 ™, a trade name of Degussa and the different organic compounds are described in table 2.

In the composition 6, the IR-dye was included into the latex particle and in composition 7 the IR-dye was absorbed on the latex particle.

TABLE 2

| Organic compound (particle size) | IR_sensitive compound | Required plane image power | Ratio organic comp./IR-sensitive comp. |
|---|---|---|---|
| 1. Polystyrene (71 nm) | carbon black | between 190 and 292 mW | 90/10 |
| 2. Polystyrene (71 nm) | carbon black | ≅190 mW | 55/45 |
| 3. Polymethylmethacrylate (72 nm) | carbon black | between 80 and 190 mW | 90/10 |
| Polymethylmethacrylate (72 nm) | carbon black | ≅292 mW | 55/45 |
| Novolac (phenol/cresol resin) | carbon black | <80 mW | 55/45 |
| Polymethylmethacrylate (1 μm) | Tab 1 Cpd 7 | between 80 and 190 mW | 94.8/5.2 |
| Polymethylmethacrylate (90 nm) | Tab 1 Cpd 7 | >292 mW | 94.8/5.2 |

After rubbing the powder in the hydrophilic aluminum surface, the obtained imaging element was exposed with a 830 nm diode laser (Isomet-3600 dpi-spot size 11 μm- at a speed of 3.2 m/s; i.e. pixel dwell time of 3.4 μs-image plane power was varied: 80 mW-190 mW-292 mW were used) and printed on a conventional offset printing machine equipped with a conventional ink and fountain solution.

Printing was started without any treatment between imaging and the press start.

All of the tested compositions resulted in good prints with good image quality.

Example 2

An aluminum support is electrochemically roughened using hydrochloric acid, anodized in sulphuric acid, and subsequently treated with polyvinylphosphonic acid.

The obtained hydrophilic surface was further used for the application of dry powders consisting of polymethylmethacrylate beads of 1 μm and graphite (GRAPHITE NATURALE™ trade name of Carbone Lorraine, France—with a particle size<20 μm as an infrared absorbing compound were used for dry rubbing in the above described hydrophilic surface of an electrochemically roughened and anodized aluminum support, using a cotton pad.

After rubbing the powder in the hydrophilic aluminum surface, the obtained imaging element was exposed with an 830 nm laser diode (Isomet-3600 dpi-spot size 11 μm-at a speed of 3.2 m/s; i.e. pixel dwell time of 3.4 μs-Image plane power was varied: 200 mW and 300 mW were used) as well as with a 1060 nm NdYLF laser (Isomet-3600 dpi-spot size 18 μm-at a speed of 3.2 m/s-image plane power was varied: 585 mW and 780 mW were used) and printed on a conventional offset printing machine equipped with a conventional ink and fountain solution system.

Printing was started without any treatment between imaging and the press start.

All of the tested powders resulted in good image quality, but sensitivity and the lithographic behavior, e.g. ink-uptake, were different.

The ink-uptake, measured by Dmax on print 100(see table 3), proves that the organic compound is needed in an amount of at least 51% to print high densities (>1.55 required); without said amount of polymethylmethacrylate-beads high densities print could not be guaranteed.

With only organic compound (no IR-absorbing compound) in the imaging material no image was formed at all.

TABLE 3

| Ratio graphite/polymethylmethacrylate 1 μm beads | Dmax (100 sheets) Isomet NdYLF 3.2 m/s | | Dmax (100 sheets) Isomet diode 3.2 m/s | |
|---|---|---|---|---|
| 100/0 | 585 mW | 1.45 | 200 mW | 0.81 |
| | 780 mW | 1.12 | 300 mW | 1.52 |
| 75/25 | 585 mW | 1.41 | 200 mW | 1.42 |
| | 780 mW | 1.52 | 300 mW | 1.49 |
| 50/50 | 585 mW | 1.43 | 200 mW | 1.51 |
| | 780 mW | 1.53 | 300 mW | 1.52 |
| 25/75 | 585 mW | 1.61 | 200 mW | 1.55 |
| | 780 mW | 1.61 | 300 mW | 1.60 |

What is claimed is:

1. A method for making a negative working non-ablative imaging material, suitable for making a lithographic printing plate, comprising the steps of applying a dry powder containing at least an organic dye which absorbs near infrared light and is capable of converting the light into heat and an organic compound on a surface of a non-electrically charged metal support, wherein the amount of organic compound in said powder ranges from 51 to 95% by weight, and the organic compound consists of organic thermoplastic polymer particles having a diameter between 0.02 and 10 μm.

2. A method according to claim 1 wherein said organic compound consists of organic thermoplastic polymer particles having a diameter between 0.05 and 2 μm.

3. A method according to claim 1 wherein said organic thermoplastic polymer particles have a reactive compound inside or outside said particles.

4. A method according to claim 1 wherein said organic thermoplastic polymer particles consist of novolac and/or polystyrene and/or a polyacrylate.

5. A method according to claim 1 wherein the organic dye is adsorbed on said polymer particles.

6. A method according to claim 1 wherein the metal support is a sleeve or a cylinder of a rotary printing press.

7. A method for making a printing plate comprising the steps of:

exposing a material prepared according to claim 1;

optionally wiping the exposed material with water.

8. A method for making a printing plate comprising the steps of:

image-wise exposing with an IR-laser a material prepared according to claim 1;

mounting the exposed material on a printing cylinder of a rotating press;

rotating said cylinder while supplying an aqueous dampening liquid and/or supplying ink to said image-wise exposed material.

9. A method for making a printing plate comprising the steps of:

mounting a material prepared according to claim 1 on a printing cylinder of a rotating press;

image-wise exposing with an IR-laser said material and;

rotating said cylinder while supplying an aqueous dampening liquid and/or supplying ink to said image-wise exposed material.

* * * * *